US006418577B1

(12) United States Patent
Murphy

(10) Patent No.: US 6,418,577 B1
(45) Date of Patent: Jul. 16, 2002

(54) PORTABLE HAMMOCK

(76) Inventor: Michael Murphy, 4203 Rimcrest Rd., Las Vegas, NV (US) 89121

( * ) Notice: Subject to any disclaimer, the term of this patent is extended or adjusted under 35 U.S.C. 154(b) by 0 days.

(21) Appl. No.: 09/923,674

(22) Filed: Aug. 6, 2001

(51) Int. Cl.[7] ..... A45F 3/24
(52) U.S. Cl. ..... 5/127; 5/120; 5/123
(58) Field of Search ..... 5/119, 120, 122, 5/123, 127

(56) References Cited

U.S. PATENT DOCUMENTS

| | | | | | |
|---|---|---|---|---|---|
| 755,039 | A | * | 3/1904 | Patten | 5/127 |
| 894,065 | A | | 7/1908 | Scanlan | |
| 986,375 | A | | 3/1911 | Fitzner | |
| 1,152,006 | A | * | 8/1915 | Clarke | 5/127 |
| 1,159,192 | A | | 11/1915 | Dudley | |
| 1,257,984 | A | | 3/1918 | Drexler | |
| 2,524,499 | A | | 10/1950 | Weir | |
| 4,662,132 | A | | 5/1987 | Tennant | |
| 4,951,332 | A | * | 8/1990 | Barmettler | 5/120 |
| 5,293,657 | A | * | 3/1994 | De Ath | 5/120 |
| 5,857,230 | A | | 1/1999 | Dowdy | |

* cited by examiner

*Primary Examiner*—Michael F. Trettel
(74) *Attorney, Agent, or Firm*—Quirk & Tratos

(57) ABSTRACT

A portable hammock designed to be used between any two rigid structures includes leg standards removably attached to opposite ends of a flexible hammock material with said leg standards removably attached to the two rigid structures. Loops of material connected to opposite ends of the flexible hammock material encase a portion of a strap rod. A system of flexible straps and hooks connect the leg standards to the flexible hammock material and the rigid structures. Two legs removably coupled to a rigid member form the leg standards. The legs and strap rods are in sections and the legs are easily removed from attachment with the rigid member permitting the portable hammock's size to be minimized during non-use. When disassembled, the portable hammock fits into a carrying bag no larger than a gym bag. In one embodiment, the portable hammock is erected between a tree and a motorcycle.

15 Claims, 7 Drawing Sheets

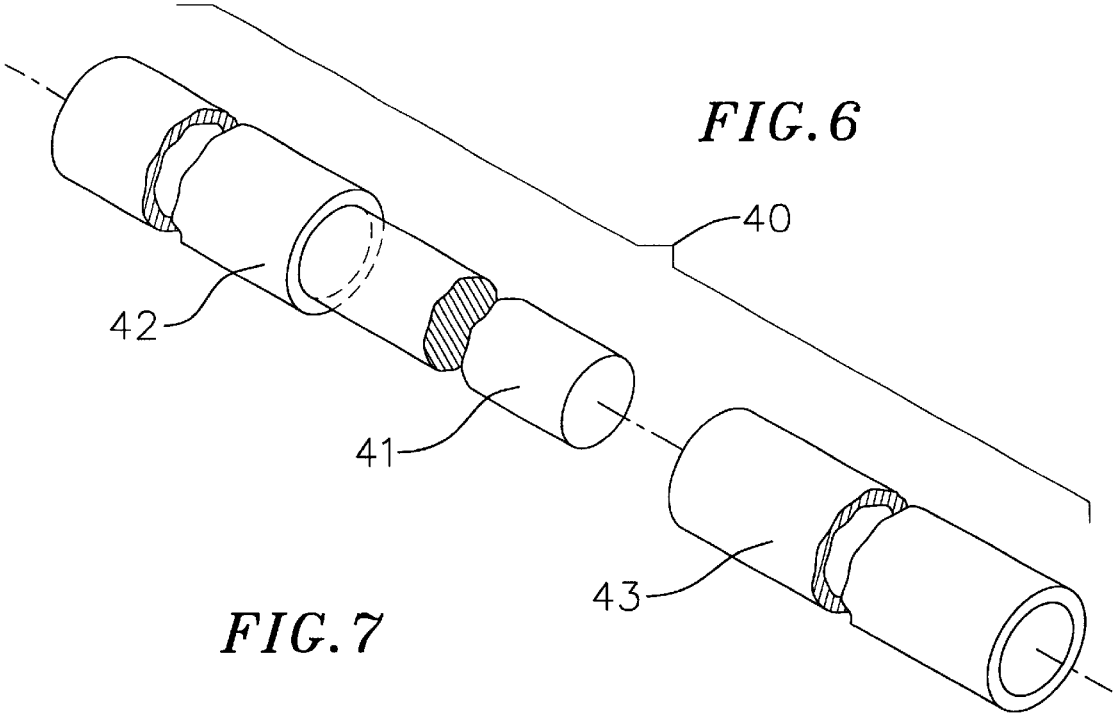
FIG. 6
FIG. 7
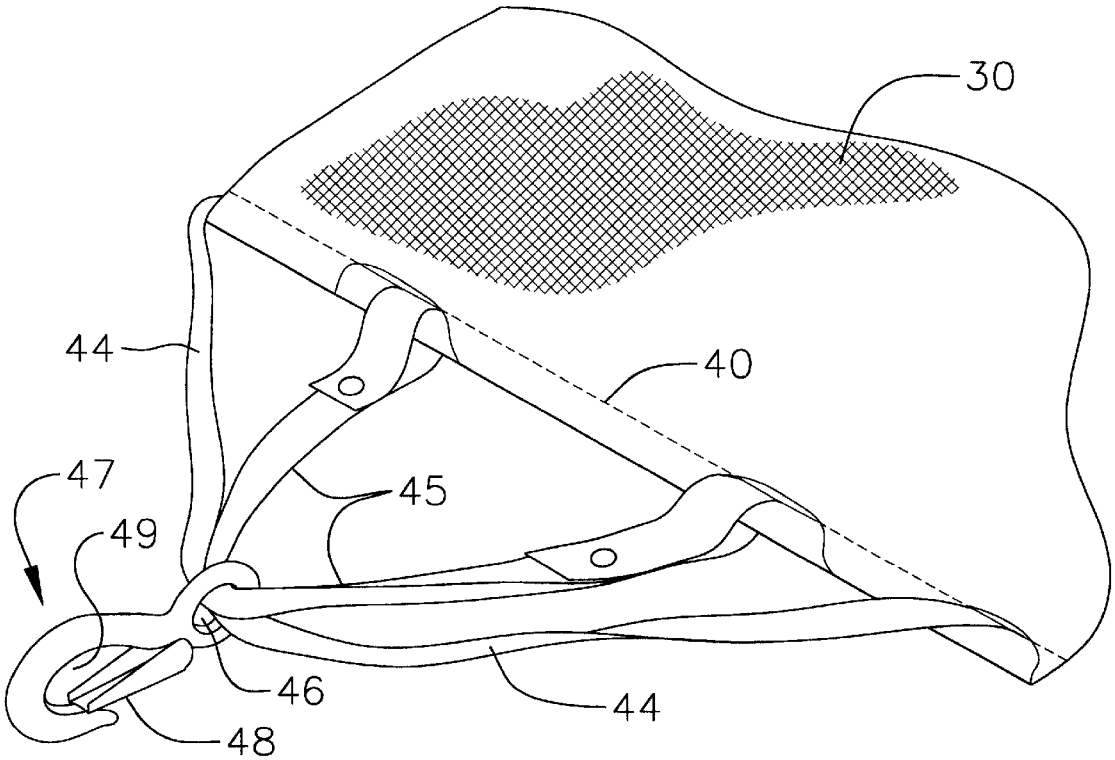

PORTABLE HAMMOCK

FIELD OF INVENTION

This invention is in the general field of hammocks, more particularly, it is a lightweight portable hammock permitting a user to quickly and easily assemble the hammock between any two fixed objects. Further, the lightweight portable hammock permits convenient disassembly, storage and transport.

DESCRIPTION OF THE PRIOR ART

It is generally accepted that the origins of the hammock began nearly 1,000 years ago in Central America by the Mayan Indians. Today, approximately 500,000 to 2,000,000 hammocks are sold yearly in North America. Incredibly, very few changes in hammock design have occurred over the last 1,000 years. However, the present invention is designed to permit easy use and transport of hammocks.

Hammocks are normally attached to, and supported by, two adjacent trees or two poles inserted into the ground. When poles or stakes are used as hammock supports the process of constructing the hammock can be tedious and unrewarding. In many cases, the poles simply do not provide ample support for one or two persons to lounge in the hammock. Further, inserting poles or stakes into the ground and attaching guidelines is not an easy task.

As evidenced by relevant hammock patents, needed is a hammock easy to configure, transport and capable of use in alternative locations. Many U.S. Patents covering hammocks and their design issued prior to 1950. The older filed and issued patents confirm that relatively few novel changes have been made to hammocks over the past half century.

U.S. Pat. No. 1,159,192 (the '192 Patent) is directed to a support for hammocks. The '192 Patent requires two supports in the form of bars, a hinge apparatus, bracing members and buried ground stakes. The hammock support described in the '192 Patent is typical of prior hammock designs in that the hammock rests between two rigidly fixed objects by means of a complicated support structure. The arrangement disclosed in the '192 Patent is complicated by the ground stakes which are used to prevent the posts from collapsing inward based on the weight of a person lying in the hammock.

U.S. Pat. No. 1,257,984 (the '984 Patent) entitled "Field Bed" claims a support structure including a simple post and cable arrangement also typical of past hammocks. The simple arrangement disclosed in the '984 Patent is subject to a high rate of failure since the posts tend to collapse inward based on the weight of a person lying in the hammock.

Several issued U.S. Patents are dedicated to hammocks supported in part by an automobile or motorcycle. The intent of these patents is to provide for a more versatile hammock.

U.S. Pat. No. 2,524,499 (the '499 Patent) discloses a hammock that is supported by an automobile and a dual leg arrangement. As with many hammocks, the '499 Patent utilizes legs for support. As mentioned previously, leg supports, are generally subject to a high failure rate. The leg supports suggested by the '499 Patent will inherently collapse inward requiring the addition of a horizontal support bar between the automobile and the leg support. The addition of the support bar complicates the design and its overall appeal.

U.S. Pat. No. 5,857,230 (the '230 Patent) discloses a hammock supported by a motorcycle and jack. It is apparent from the drawings of the '230 Patent that the hammock is uncomfortable for a person of normal height. Moreover, the design includes an inherently unstable jack arrangement akin to past pole support hammock arrangements.

Applicant's invention permits a user to quickly and easily configure a stable hammock between any two rigid support objects. In one embodiment the portable hammock disclosed is supported between a motorcycle, car or the like and a second rigid support object such as a tree. However, the use of the portable hammock is limited only by the discovery of two adjacent support objects.

SUMMARY OF THE INVENTION

An object of the present invention is to provide a stable portable hammock.

Another object of the present invention is to permit convenient transport of a hammock for use during travel or hiking.

Another object of the present invention is to permit a motorcycle, car or the like to be used as at least one support object of the hammock.

A further object is to provide a portable hammock capable of easy disassembly during non-use.

According to the present invention, a portable hammock includes leg standards, securing straps, flexible hammock support material and means to removably connect the flexible hammock material to the leg standards.

In a preferred embodiment two hollow tubular legs and a rigid member form a a leg standard. The rigid member includes two remote tubular extensions on a bottom surface for insertion into top openings of the tubular legs. The remote tubular extensions are positioned near either end of the rigid member and have a diameter slightly less than the diameter of the top openings of the legs.

Telescoping legs allow the portable hammock to be easily constructed and transported. When fully extended, three leg sections are held in place by means of holes and resilient pins. The outer section includes two holes separated by 180 degrees and the middle section includes two resilient pins which during extension align with, and insert into, the two holes in the outer section. In a similar arrangement, the middle section includes two holes. separated by 180 degrees and the inner section includes two resilient pins which during extension align with, and insert into, the two holes in the middle section.

Leg standards are formed when the remote tubular extensions are inserted into a top opening of the fully extended hollow tubular legs. Friction provides for a secure connection and allows a user to dismantle easily. Those skilled in the art will recognize that friction is only one of a vast number of methods of securing the legs to the rigid member. The leg standards provide the support in reaction to the weight of a user. Each leg is fitted with non-slip feet. The non-slip feet contact the ground during use of the portable hammock providing a stable hammock arrangement.

The rigid member further includes three voids to receive securing strap hooks and hammock hooks. Outer voids on each end of the rigid member are positioned between the remote tubular extensions and opposite outer edges of the rigid member. A center void is positioned between the two remote tubular extensions. The positioning of the voids provides an extremely stable hammock arrangement.

Securing straps and hooks allow the portable hammock to be used in nearly any location provided two fixed objects are available. A buckle disposed between two securing straps allows the length of the straps to be adjusted. The buckle includes a clamp for securing the strap during use. Hooks on a first end of the securing straps attach to the fixed objects and hooks on a second end of the securing straps attach to the center void of the rigid member. The arrangement permits versatility and prevents collapse of the portable hammock during use.

Flexible hammock support material includes a first end and a second end. Each end of the support material includes loops of material which encase portions of a hollow strap rod. The hollow strap rods comprise two sections removably coupled by a dowel. The dowel extends from an opening in a first section and is inserted into an opening of the second section forming the hollow strap rod. The diameter of the dowel is slightly less than the diameter of the second section providing a tight coupling. During non-use the user can easily dismantle the hollow strap rods for storage and transport.

Hammock straps are used to connect the flexible hammock material to the rigid member. Two hammock straps are connected to each section of the assembled hollow strap rods. Each hammock strap is threaded through an eye of a hammock hook, one for each section of the hollow strap rods, prior to being connected to, or wrapped around, the hollow strap rods. Thus four hammock hooks are utilized by the present invention. The hammock hooks include a resilient toggle rotatably connected to the hook adjacent the eye creating a. defined void with the hook. Each hammock hook is inserted through an outer void in the rigid members such that the resilient toggle and hook engage the rigid member. The resilient toggle prevents the hooks from accidentally disengaging with the rigid member. To disengage the hook the toggle is depressed providing an opening to remove the hook from the rigid member.

The legs removably coupled to the rigid member, telescoping legs and removably coupled hollow strap rod sections render the present design easy to construct and dismantle for storage and transport. Other objects, features, and advantages of the invention will become apparent to those skilled in the art upon consideration of the following detailed description of the preferred embodiments thereof as illustrated in the accompanying drawings.

BRIEF DESCRIPTION OF THE DRAWINGS

FIG. 6 is a perspective view of a hollow strap rod disengaged and including a connecting dowel of the present invention;

FIG. 7 is a perspective view of a hammock hook and hammock straps of the present invention;

DESCRIPTION OF THE EMBODIMENTS

Figure 1:
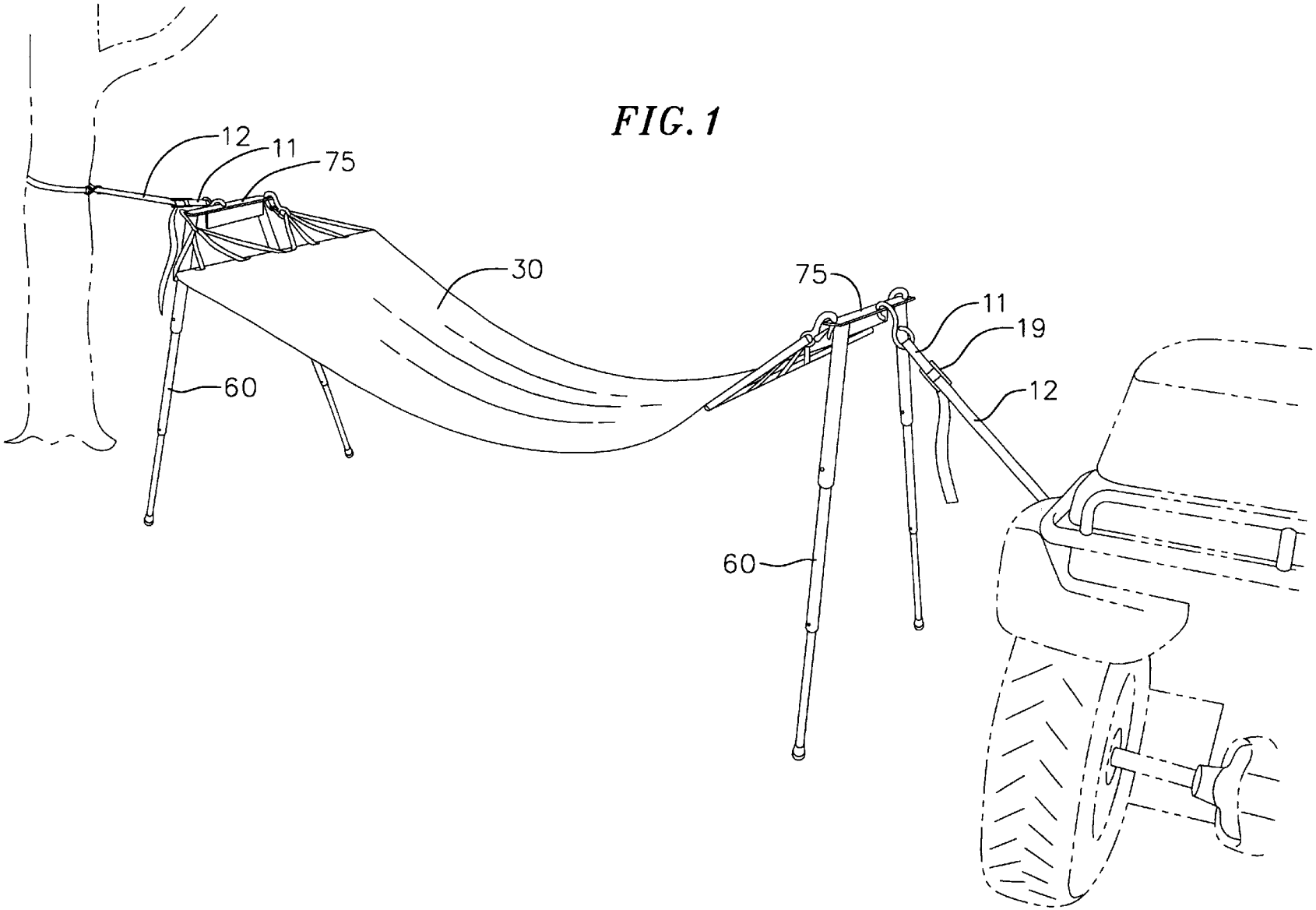
FIG. 1 is a perspective view of the present invention supported by a tree and motorcycle.

Reference is now made to the figures wherein like parts are referred to by like numerals throughout. Referring to FIG. 1, the portable hammock is supported by a tree and motorcycle. However, any two fixed objects will support construction of the portable hammock. Securing straps 11,12 removably attach flexible hammock material 30 to the tree and motorcycle. Leg standards 50 comprise two hollow tubular legs 60 and a rigid member 75 and provide support in a direction opposite the weight of users.

Figure 2:
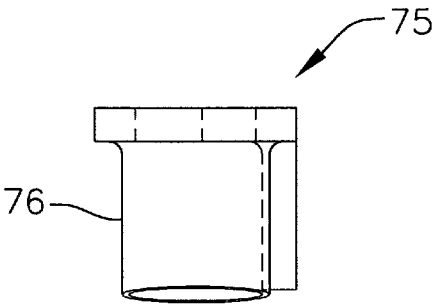
FIG. 2 is a side end view of the rigid member of the present invention.
Figure 3:
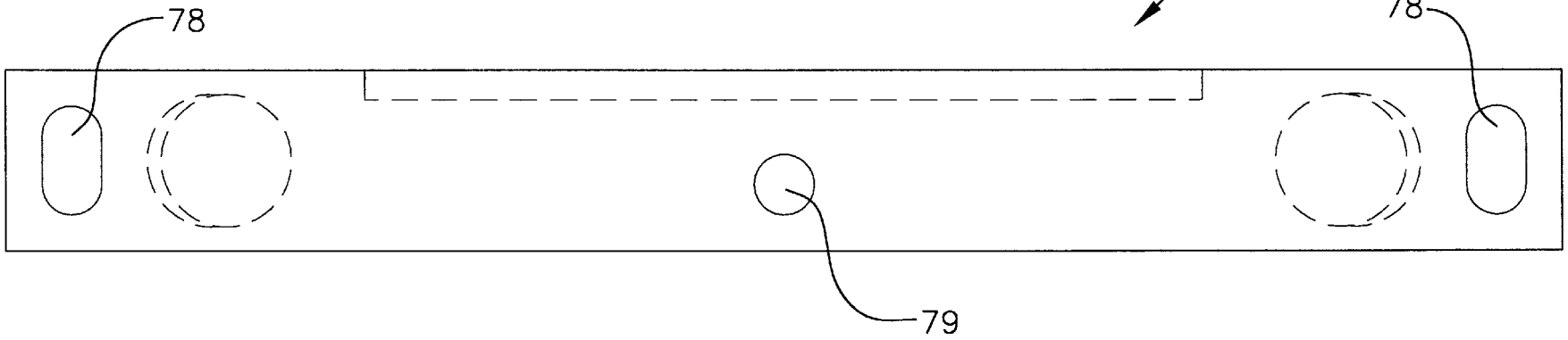
FIG. 3 is a top view of the rigid member of the present invention.

Referring now to FIGS. 2 and 3, the rigid member 75 includes two remote tubular extensions 76 on a bottom surface that insert into top openings 55 of the tubular legs 60. The remote tubular extensions 76 are positioned near either end of the rigid member and have a diameter slightly less than the diameter of the top openings 55 of the legs 60 providing a tight connection therebetween.

Figure 4:
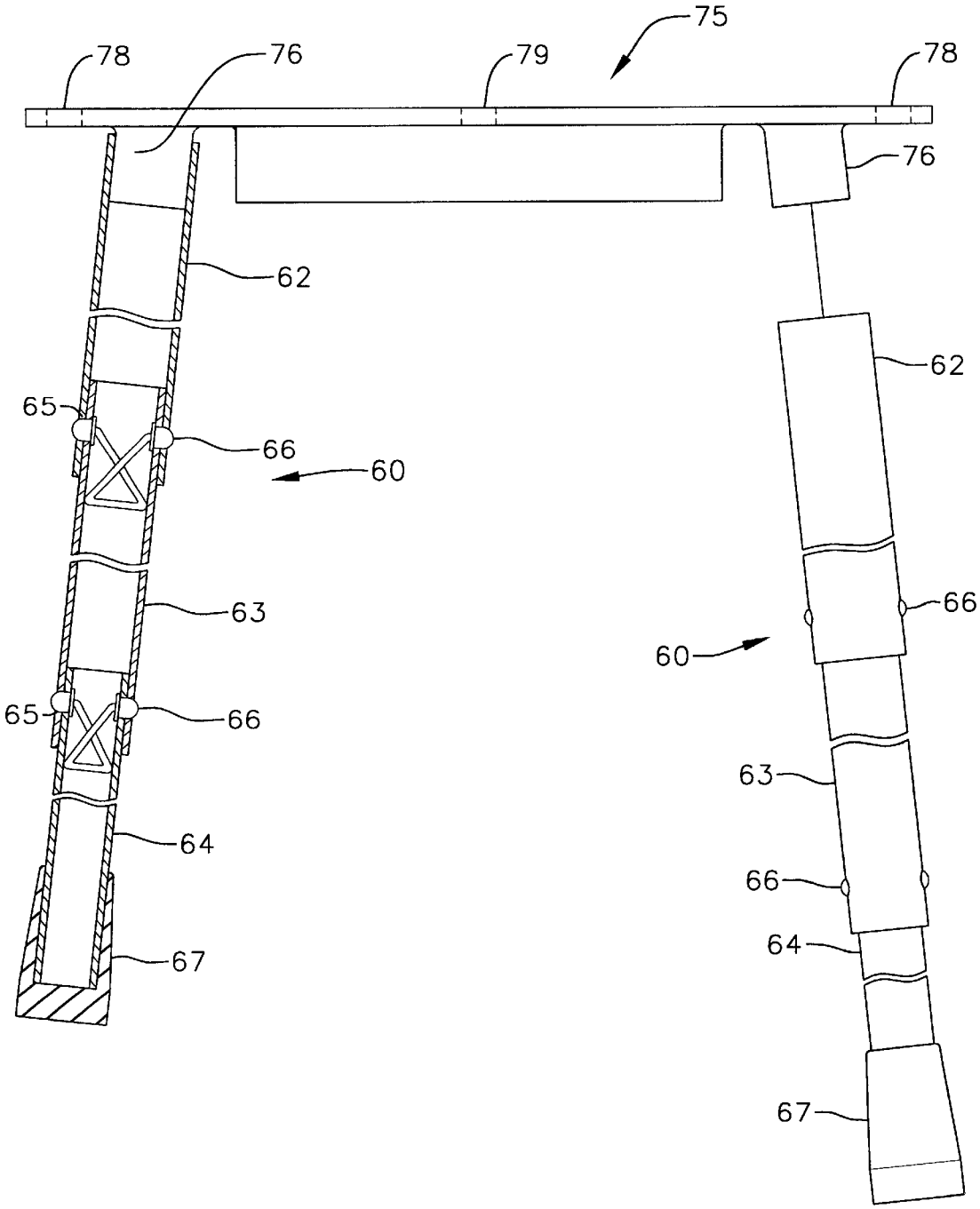
FIG. 4 is a front view of a leg standard showing the relationship between the individual sections (e.g. legs and rigid member) of the present invention and showing the range of the legs' motion (the view of the left leg is transparent to show the inner portions)

Referring now to FIG. 4, the legs 60 include an outer section 62, middle section 63 and inner section 64 permitting the legs 60 to telescope. The inner section 64 is disposed within the middle section 63 which is disposed similarly within the outer section 62 allowing the outer section 62 to extend along the length of the middle section 63. The inner section 64 extends outward from within the middle section 63. When fully extended, the outer section 62 and inner section 64 are held in place by means of holes 65 and resilient pins 66. The outer section 62 includes two holes 65 separated by 180 degrees and the middle section 63 includes two resilient pins 66 which during extension align with, and insert into, the two holes 65 in the outer section 62. In a similar arrangement, the middle section 63 includes two holes 65 separated by 180 degrees and the inner section 64 includes two resilient pins 66 which during extension align with, and insert into, the two holes 65 in the middle section 63. In the preferred embodiment the legs 60 are circular to facilitate the telescoping effect. However, those skilled in the art will realize that the legs 60 can take any shape.

The legs 60 telescope such that upon extension the outer section 62 forms the upper portion of the leg 60 and the inner section 64 forms the lower portion of the leg 60. A first end of the top portion of the hollow leg 60 accepts the remote tubular extensions 76 of the rigid member 75. The diameter of the remote tubular extensions 76 is slightly less than the diameter of the opening of the top portion of the leg 60 permitting friction to maintain the connection.

The legs 60 are extended by traversing the outer section 62 along the length of the middle section 63 until the holes 65 in the outer section 62 mate with the resilient pins 66 penetrating apertures adjacent one end of the middle section 63 and the inner section 64 is traversed from within the middle section 63 until the holes 65 adjacent a second end of the middle section 63 mate with resilient pins 66 penetrating apertures adjacent one end of the inner section 64. To contract the legs 60 for storage the resilient pins 66 are depressed disposing the middle section 63 within the outer section 62 and the inner section 64 within the middle section 63.

Non-slip feet 67 are securely attached to a lower portion of each leg 60 that contacts the ground during use of the portable hammock. Typically the non-slip material will be rubber or plastic similar to the non-slip material on the bottom portion of a medical crutch.

Referring now to FIG. 3, the rigid member 75 further includes three voids to receive securing strap hooks 11 and hammock hooks 12. The three voids are spaced uniformly along the length of the rigid member 75. Outer voids 78 on each end of the rigid member 75 are positioned between the remote tubular extensions 76 and opposite outer edges of the rigid member 75. A center void 79 is positioned between the two remote tubular extensions 76. The positioning of the voids provides an extremely stable hammock arrangement.

Figure 5:
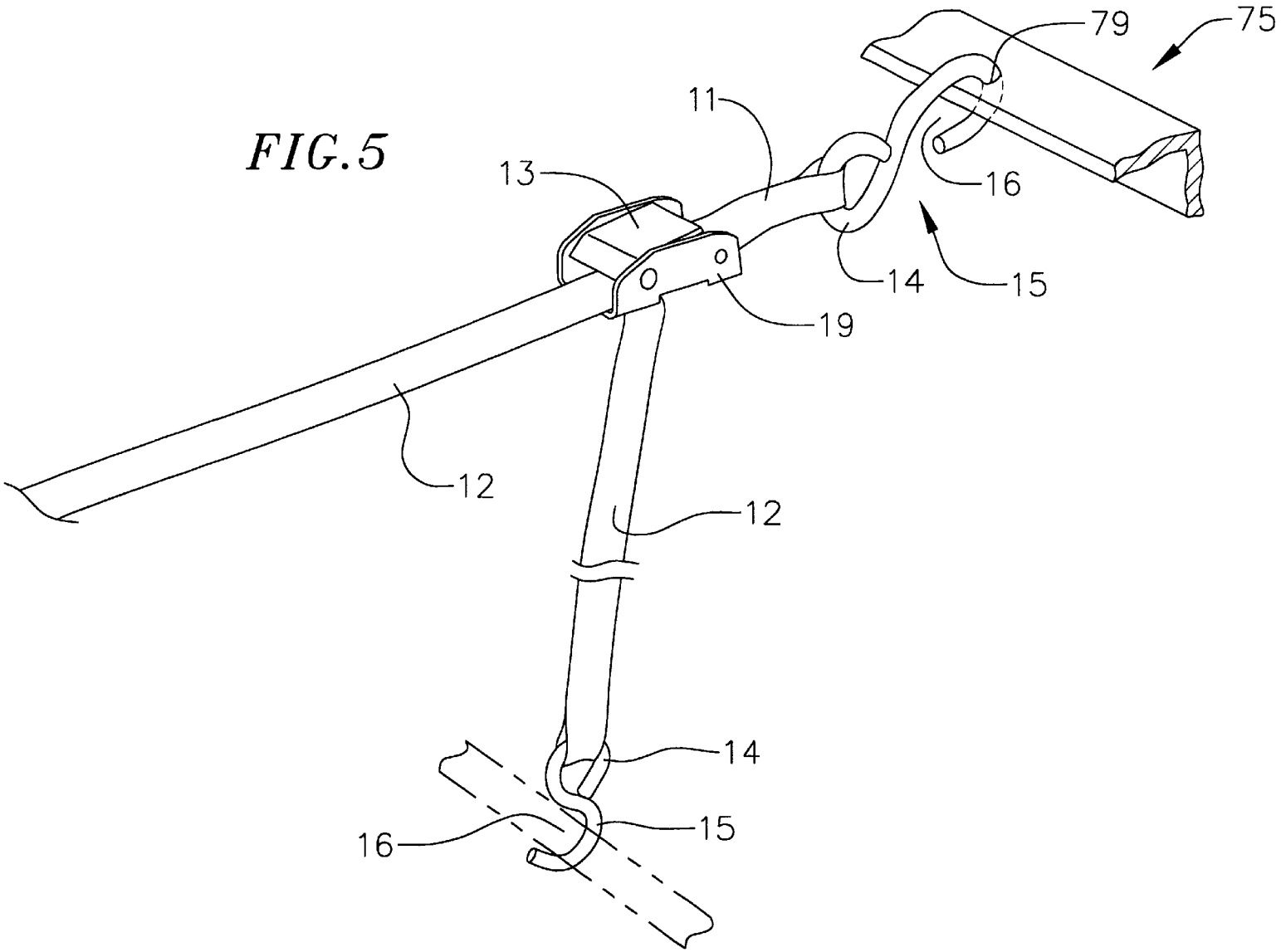
FIG. 5 is a perspective view of a securing strap, buckle and S-shaped hook of the present invention.

Referring now to FIG. 5, a buckle 19 is disposed between a first securing strap 11 and a second securing strap 12. A first end of the first securing strap 11 is permanently connected to the buckle 19. A first end of the second securing strap 12 is passed through a buckle opening and adjustably secured by a spring biased buckle clamp 13. Seconds ends of the first securing strap 11 and second securing strap 12 are rigidly connected to closed ends 14 of S-shaped hooks 15.

Both ends of the portable hammock utilize a buckle 19 and securing straps 11,12 to secure the hammock to fixed objects. Open ends 16 of first S-shaped hooks 15 are used to attach the securing strap 12 to a motorcycle, car, tree or the like at opposite ends of the portable hammock. The spring biased buckle clamp 13 provides adjustability of the length of the second securing strap 12. In another embodiment, the second securing strap 12 is wrapped around a large fixed object such as a tree trunk, cement pillar or the like and the open end 16 of the S-shaped hook 15 is attached to a portion of the second securing strap 12 creating a secure loop around the large fixed object. Open ends 16 of second S-shaped hooks 15 are attached to the center voids 79 of the rigid members 75.

Figure 8:
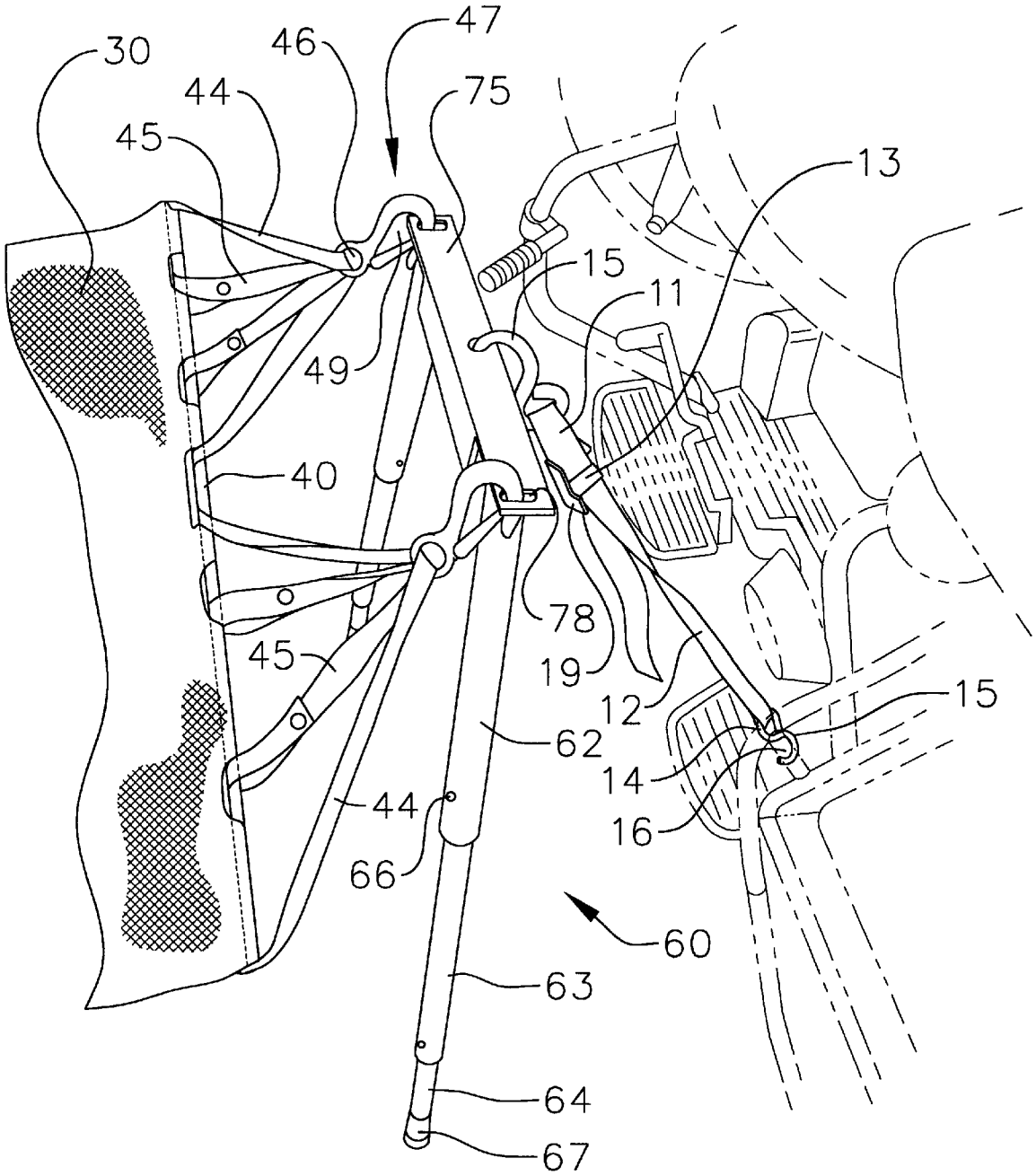
FIG. 8 is an upper perspective view of one end of the hammock during use.

Referring now the FIGS. 6, 7 and 8, the flexible hammock support material 30 includes a first end 31 and a second end 32. Each end 31,32 of the hammock support material 30 includes loops of hammock material which encases portions of two hollow strap rods 40. The hollow strap rods 40 comprise two sections removably coupled by a dowel 41 rigidly attached to one end of the first section 42. The dowel 41 is inserted into an opening of the second section 43 forming the hollow strap rod 40. The diameter of the dowel 41 is slightly less than the diameter of the second section 43 providing a tight coupling. During non-use the hollow strap rods 40 are stored in two sections.

Four hammock straps are used to connect the hammock support material 30 to the rigid member 75. Two hammock straps are connected to a first section 42 and a second section 43 of the assembled hollow strap rods 40. Ends of a first strap 44 are rigidly connected adjacent to ends of each section 42, 43 of the hollow strap rods 40. Ends of a second strap 45 are each wrapped around the hollow strap rods 40 at points not covered by the hammock support material 30 which encases portions of the hollow strap rods 40 and between the first strap 44 connections.

Each hammock strap 44, 45 is threaded through an eye 46 of a hammock hook 47. One hammock hook 47 is utilized for each section 42, 43 of the hollow strap rods 40, prior to being connected, or wrapped around, the hollow strap rods 40. Thus four hammock hooks 47 are utilized by the present invention. The hammock hooks 47 include a resilient toggle 48 rotatably connected to the hook 47 adjacent the eye 46 creating a defined void 49 with the hook 47. Each hammock hook 47 is inserted through an outer void 78 in the rigid members 75 such that the resilient toggle 48 and hook 47 engage the rigid member 75. The resilient toggle 48 prevents the hammock hook 47 from accidentally disengaging with. the rigid member 75.

Figure 9:
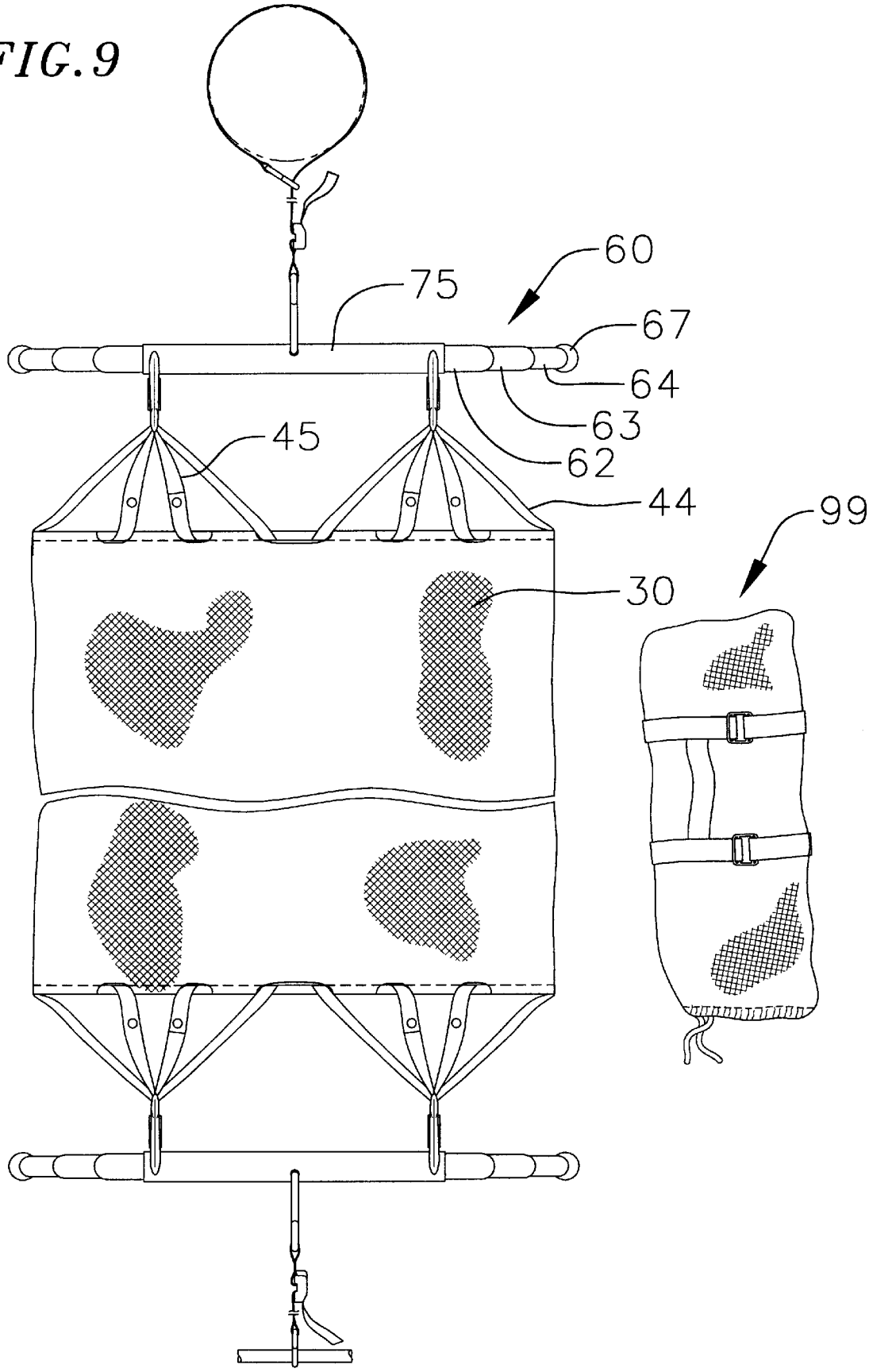
FIG. 9 is a scaled top view of the hammock during use and the bag utilized to store and transport the hammock during non-use.

Referring now to FIG. 9, a transport bag 99 capable of storing the entire portable hammock for transport is shown to scale. The legs removably coupled to the rigid member, telescoping legs and removably coupled hollow strap rod sections render the present design easy to construct and dismantle for storage and transport.

Although the invention has been described in detail with reference to a preferred embodiment, additional variations and modifications exist within the scope and spirit of the invention as described and defined in the following claims.

I claim:

1. A portable hammock including:

opposite ends of a flexible hammock material each removably attached to a leg standard;

said opposite ends of the flexible hammock material each connected to loops of flexible material which encase portions of a strap rod, each said strap rod comprising a first section and a second section removably joined during use of the portable hammock;

each said leg standard removably attached to a rigid structure capable of providing support;

each said leg standard comprising at least two legs and a rigid member integrated therebetween; and said two legs each removably engaging the rigid member adjacent opposite ends of the rigid member.

2. The portable hammock of claim 1 wherein the first section and the second section are hollow with a portion of a dowel inserted into an end of the first section, said dowel having an exposed portion for insertion into an end of the second section.

3. The portable hammock of claim 1 wherein the rigid member includes three spaced apertures comprising two outer apertures adjacent opposite ends and an central aperture located therebetween.

4. The portable hammock of claim 3 wherein the rigid member further includes two tubular extensions from a bottom surface adjacent opposite ends of the rigid member removably coupled with first ends of the two legs.

5. The portable hammock of claim 4 wherein second ends of the legs include non-slip covers to prevent hammock collapse during use.

6. The portable hammock of claim 3 wherein the flexible hammock material is removably attached to the leg standards by at least one hook inserted into one of said apertures of the rigid member, said at least one hook attached to the strap rods by flexible straps of material.

7. The portable hammock of claim 6 wherein two hammock hooks removably attach each end of the flexible hammock material to the leg standards such that each outer aperture receives a hammock hook.

8. The portable hammock of claim 7 wherein the hammock hooks include a spring-biased resilient toggle such that the toggle and hammock hook completely engage the rigid member whereby said engagement may only be interrupted by depressing the resilient toggle.

9. The portable hammock of claim 3 wherein a flexible support strap includes a strap hook at both ends, a first strap hook is inserted into the center aperture of the rigid member and a second strap hook engages a rigid structure capable of providing support.

10. The portable hammock of claim 9 wherein the strap hooks are S-shaped.

11. The portable hammock of claim 9 further including a buckle integrated between the two ends of the flexible support strap permitting the length of the support strap to be adjusted.

12. The portable hammock of claim 9 wherein at least one rigid structure is a motorcycle.

13. The portable hammock of claim 3 wherein a flexible support strap includes a strap hook at both ends, a first strap hook is inserted into the center aperture of the rigid member and a second strap hook engages the flexible support strap after said support strap is wrapped around a rigid structure.

14. A portable hammock including:

opposite ends of a flexible hammock material removably each attached to a leg standard;

said opposite ends of the flexible hammock material each connected to loops of flexible material which encase portions of a strap rod;

each said strap rod comprises a first section and a second section removably joined during use of the portable hammock;

each said leg standard removably attached to a rigid structure capable of providing support;

each said leg standard comprising at least two legs and a rigid member integrated therebetween;

said two legs each removably engaging the ridgid member adjacent opposite ends of the rigid member; and said legs able to telescope in length.

15. The portable hammock of claim 14 wherein the portable hammock may be disassembled and stored in a carrying bag by the following steps:

a. disengaging attachment of leg standard to rigid structure;

b. disengaging leg engagement to leg standard;

c. disengaging attachment of flexible hammock material to leg standard;

d. disjoining the first section and the second section of the strap rods;

e. folding said flexible hammock material along a centerline from a first end to a second end;

f. rolling the flexible hammock material along its length beginning with the disjoined strap rod at one said end of the flexible hammock material; and g. placing all individual pieces of said portable hammock into said carrying bag.

* * * * *

UNITED STATES PATENT AND TRADEMARK OFFICE

CERTIFICATE OF CORRECTION

PATENT NO. : 6,418,577 B1
DATED : July 16, 2002
INVENTOR(S) : Michael Murphy

It is certified that error appears in the above-identified patent and that said Letters Patent is hereby corrected as shown below:

Column 6,
Line 30, change "an," to -- a --;

Signed and Sealed this

Third Day of September, 2002

*Attest:*

*Attesting Officer*

JAMES E. ROGAN
*Director of the United States Patent and Trademark Office*